US007905994B2

(12) United States Patent
Dubin et al.

(10) Patent No.: US 7,905,994 B2
(45) Date of Patent: Mar. 15, 2011

(54) SUBSTRATE HOLDER AND ELECTROPLATING SYSTEM

(75) Inventors: Valery M. Dubin, Portland, OR (US); James D. Blanchard, Soap Lake, WA (US)

(73) Assignee: Moses Lake Industries, Inc., Moses Lake, WA (US)

( * ) Notice: Subject to any disclaimer, the term of this patent is extended or adjusted under 35 U.S.C. 154(b) by 669 days.

(21) Appl. No.: 11/906,882

(22) Filed: Oct. 3, 2007

(65) Prior Publication Data

US 2009/0090631 A1 Apr. 9, 2009

(51) Int. Cl.
*C25B 9/02* (2006.01)

(52) U.S. Cl. ..... 204/297.1; 204/297.14; 204/297.01; 204/297.06; 204/297.08; 204/297.09; 269/37; 269/40; 269/287

(58) Field of Classification Search ..... 204/297.01, 204/297.03, 297.06, 297.08, 297.09, 297.1, 204/297.14
See application file for complete search history.

(56) References Cited

U.S. PATENT DOCUMENTS

| | | | |
|---|---|---|---|
| 2,689,808 | A | 9/1954 | Crayton |
| 3,132,043 | A | 5/1964 | Clayton |
| 3,383,293 | A | 5/1968 | Matthews |
| 3,460,977 | A | 8/1969 | Golben |
| 3,615,272 | A | 10/1971 | Collins et al. |
| 3,832,291 | A | 8/1974 | Arcilesi |
| 3,855,085 | A | 12/1974 | Rushmere |
| 3,932,659 | A | 1/1976 | Green et al. |
| 3,998,707 | A | 12/1976 | Fong |
| 4,045,305 | A | 8/1977 | Fong et al. |
| 4,049,505 | A | 9/1977 | Chatterji |
| 4,049,510 | A | 9/1977 | Rosenberg |
| 4,070,256 | A | 1/1978 | Hsu et al. |
| 4,072,582 | A | 2/1978 | Rosenberg |
| 4,075,066 | A | 2/1978 | Eckles et al. |
| 4,134,803 | A | 1/1979 | Eckles et al. |
| 4,139,425 | A | 2/1979 | Eckles |
| 4,146,441 | A | 3/1979 | Willis |
| 4,146,442 | A | 3/1979 | McFarland |

(Continued)

FOREIGN PATENT DOCUMENTS

DE 2610705 9/1977

(Continued)

OTHER PUBLICATIONS

BASF Corporation, Pluronic and Tetronic Surfactants, 1999.

(Continued)

*Primary Examiner* — Bruce F Bell
(74) *Attorney, Agent, or Firm* — Nutter McClennen & Fish LLP

(57) ABSTRACT

In one embodiment, a substrate holder comprises a base supporting a substrate that includes a surface having a peripheral region. A cover may be assembled with the base and includes at least one opening exposing only a portion of the surface therethrough. A seal assembly substantially seals a region between the cover and base and further adjacent to the peripheral region of the substrate. An electrode includes at least one contact portion positioned within the region and extending over at least a portion of the peripheral region of the substrate. A compliant member comprises a polymeric material and may be positioned within the region between the at least one contact portion and either the peripheral region of the substrate or the cover. In other embodiments, an electroplating system is disclosed that may employ such a substrate holder.

20 Claims, 12 Drawing Sheets

U.S. PATENT DOCUMENTS

| | | | |
|---|---|---|---|
| 4,162,947 | A | 7/1979 | Canaris |
| 4,218,292 | A | 8/1980 | Fellman et al. |
| 4,285,802 | A | 8/1981 | Rynne |
| 4,336,114 | A | 6/1982 | Mayer et al. |
| 4,347,108 | A | 8/1982 | Willis |
| 4,374,709 | A | 2/1983 | Combs |
| 4,376,685 | A | 3/1983 | Watson |
| 4,384,930 | A | 5/1983 | Eckles |
| 4,388,160 | A | 6/1983 | Rynne |
| 4,399,266 | A | 8/1983 | Matsumura et al. |
| 4,417,957 | A | 11/1983 | Rosenberg |
| 4,512,856 | A | 4/1985 | Paneccasio |
| 4,530,741 | A | 7/1985 | Rosenberg |
| 4,545,870 | A | 10/1985 | Rosenberg |
| 4,582,576 | A | 4/1986 | Opaskar et al. |
| 4,662,999 | A | 5/1987 | Opaskar et al. |
| 4,880,132 | A | 11/1989 | Coch et al. |
| 4,885,064 | A | 12/1989 | Bokisa et al. |
| 4,898,652 | A | 2/1990 | Bammel et al. |
| 4,999,397 | A | 3/1991 | Weiss et al. |
| 5,051,154 | A | 9/1991 | Bernards et al. |
| 5,174,887 | A | 12/1992 | Federman et al. |
| 5,232,575 | A | 8/1993 | Dodd |
| 5,252,196 | A | 10/1993 | Sonnenberg et al. |
| 5,282,954 | A | 2/1994 | Opaskar |
| 5,328,589 | A | 7/1994 | Martin |
| 5,415,762 | A | 5/1995 | Allardyce et al. |
| 5,433,840 | A | 7/1995 | Dahms et al. |
| 5,528,000 | A | 6/1996 | Allardyce et al. |
| 5,534,649 | A | 7/1996 | Cho et al. |
| 5,575,898 | A | 11/1996 | Wolf et al. |
| 5,656,148 | A | 8/1997 | Martyak et al. |
| 5,698,087 | A | 12/1997 | Bokisa |
| 5,833,820 | A | 11/1998 | Dubin |
| 5,882,498 | A | 3/1999 | Dubin et al. |
| 5,965,679 | A | 10/1999 | Godschalx et al. |
| 5,972,192 | A | 10/1999 | Dubin et al. |
| 6,024,856 | A | 2/2000 | Haydu et al. |
| 6,024,857 | A | 2/2000 | Reid |
| 6,077,405 | A | 6/2000 | Biggs et al. |
| 6,083,838 | A | 7/2000 | Burton et al. |
| 6,093,636 | A | 7/2000 | Carter et al. |
| 6,107,357 | A | 8/2000 | Hawker et al. |
| 6,113,771 | A | 9/2000 | Landau et al. |
| 6,129,830 | A | 10/2000 | Senge et al. |
| 6,193,789 | B1 | 2/2001 | Honma et al. |
| 6,204,202 | B1 | 3/2001 | Leung et al. |
| 6,231,989 | B1 | 5/2001 | Chung et al. |
| 6,251,710 | B1 | 6/2001 | Radens et al. |
| 6,258,241 | B1 | 7/2001 | Takahashi |
| 6,277,450 | B1 | 8/2001 | Katoot et al. |
| 6,284,121 | B1 | 9/2001 | Reid |
| 6,338,411 | B1 | 1/2002 | katabe |
| 6,344,129 | B1 | 2/2002 | Rodbell et al. |
| 6,344,413 | B1 | 2/2002 | Zurcher et al. |
| 6,350,366 | B1 | 2/2002 | Landau et al. |
| 6,350,386 | B1 | 2/2002 | Lin |
| 6,352,467 | B1 | 3/2002 | Somekh et al. |
| 6,358,388 | B1 | 3/2002 | Bleck et al. |
| 6,358,832 | B1 | 3/2002 | Edelstein et al. |
| 6,362,099 | B1 | 3/2002 | Gandikota et al. |
| 6,368,484 | B1 | 4/2002 | Volant et al. |
| 6,368,966 | B1 | 4/2002 | Krishnamoorthy et al. |
| 6,379,522 | B1 | 4/2002 | Landau et al. |
| 6,379,745 | B1 | 4/2002 | Kydd et al. |
| 6,380,083 | B1 | 4/2002 | Gross |
| 6,395,199 | B1 | 5/2002 | Krassowski et al. |
| 6,403,481 | B1 | 6/2002 | Matsuda et al. |
| 6,406,794 | B1 | 6/2002 | Shiota et al. |
| 6,413,882 | B1 | 7/2002 | Leung et al. |
| 6,423,770 | B1 | 7/2002 | Katz |
| 6,425,996 | B1 | 7/2002 | Dahms et al. |
| 6,432,821 | B1 | 8/2002 | Dubin et al. |
| 6,444,110 | B2 | 9/2002 | Barstad et al. |
| 6,465,606 | B2 | 10/2002 | Evans |
| 6,491,806 | B1 | 12/2002 | Dubin et al. |
| 6,511,912 | B1 | 1/2003 | Chopra et al. |
| 6,518,182 | B1 | 2/2003 | Ishikawa et al. |
| 6,531,046 | B2 | 3/2003 | Morrissey et al. |
| 6,544,399 | B1 | 4/2003 | Landau et al. |
| 6,551,487 | B1 | 4/2003 | Reid et al. |
| 6,562,555 | B2 | 5/2003 | Fiebag et al. |
| 6,569,302 | B1 * | 5/2003 | Steinrucke ..... 204/297.1 |
| 6,596,151 | B2 | 7/2003 | Landau et al. |
| 6,605,204 | B1 | 8/2003 | Martyak et al. |
| 6,607,654 | B2 | 8/2003 | Lee et al. |
| 6,610,191 | B2 | 8/2003 | Landau et al. |
| 6,610,192 | B1 | 8/2003 | Step et al. |
| 6,645,364 | B2 | 11/2003 | Calvert et al. |
| 6,649,038 | B2 | 11/2003 | Mikkola et al. |
| 6,660,153 | B2 | 12/2003 | Merricks et al. |
| 6,676,823 | B1 | 1/2004 | Bokisa |
| 6,679,983 | B2 | 1/2004 | Morrissey et al. |
| 6,682,642 | B2 | 1/2004 | Mikkola et al. |
| 6,685,817 | B1 | 2/2004 | Mathieu |
| 6,706,418 | B2 | 3/2004 | Egli et al. |
| 6,709,562 | B1 | 3/2004 | Andricacos et al. |
| 6,709,564 | B1 | 3/2004 | Tench et al. |
| 6,740,221 | B2 | 5/2004 | Cheung et al. |
| 6,743,211 | B1 | 6/2004 | Prausnitz et al. |
| 6,746,589 | B2 | 6/2004 | Mishima et al. |
| 6,773,568 | B2 | 8/2004 | Egli et al. |
| 6,774,051 | B2 | 8/2004 | Chung et al. |
| 6,776,893 | B1 | 8/2004 | Too et al. |
| 6,797,142 | B2 | 9/2004 | Crosby |
| 6,797,146 | B2 | 9/2004 | Morrissey et al. |
| 6,800,188 | B2 | 10/2004 | Hagiwara et al. |
| 6,835,294 | B2 | 12/2004 | Tsuchida et al. |
| 6,844,274 | B2 * | 1/2005 | Yoshioka et al. ..... 438/800 |
| 6,881,319 | B2 | 4/2005 | Seita et al. |
| 6,893,550 | B2 | 5/2005 | Dubin et al. |
| 6,924,224 | B2 | 8/2005 | Egitto et al. |
| 6,926,922 | B2 | 8/2005 | Leung et al. |
| 6,946,716 | B2 | 9/2005 | Andricacos et al. |
| 7,105,082 | B2 | 9/2006 | Hardikar |
| 7,128,822 | B2 | 10/2006 | Wang et al. |
| 7,179,736 | B2 | 2/2007 | Kwak et al. |
| 7,182,849 | B2 | 2/2007 | Shih et al. |
| 7,204,865 | B2 | 4/2007 | Yamada |
| 7,303,992 | B2 | 12/2007 | Paneccasio et al. |
| 7,316,772 | B2 | 1/2008 | Commander et al. |
| 7,335,288 | B2 | 2/2008 | Hardikar |
| 7,338,689 | B2 | 3/2008 | Shin et al. |
| 7,344,986 | B2 | 3/2008 | Inoue et al. |
| 7,368,045 | B2 | 5/2008 | Vereecken et al. |
| 7,371,311 | B2 | 5/2008 | Zierath et al. |
| 7,405,163 | B1 | 7/2008 | Drewery et al. |
| 7,413,976 | B2 | 8/2008 | Shih et al. |
| 7,429,401 | B2 | 9/2008 | Josell et al. |
| 7,439,182 | B2 | 10/2008 | Hong |
| 7,442,267 | B1 | 10/2008 | Webb et al. |
| 7,449,098 | B1 | 11/2008 | Mayer et al. |
| 7,510,993 | B2 | 3/2009 | Levey et al. |
| 7,524,347 | B2 | 4/2009 | Sun et al. |
| 7,575,666 | B2 | 8/2009 | Watkowski et al. |
| 7,598,168 | B2 | 10/2009 | Han et al. |
| 2001/0015321 | A1 | 8/2001 | Reid et al. |
| 2001/0047943 | A1 | 12/2001 | Barstad et al. |
| 2002/0000382 | A1 | 1/2002 | Morrissey et al. |
| 2002/0043467 | A1 | 4/2002 | Morrissey et al. |
| 2002/0043468 | A1 | 4/2002 | Mikkola et al. |
| 2002/0053519 | A1 | 5/2002 | Morrissey et al. |
| 2002/0074231 | A1 | 6/2002 | Mikkola et al. |
| 2002/0074242 | A1 | 6/2002 | Morrissey et al. |
| 2002/0084193 | A1 | 7/2002 | Merricks et al. |
| 2002/0088713 | A1 | 7/2002 | Merricks et al. |
| 2002/0090484 | A1 | 7/2002 | Merricks et al. |
| 2002/0112964 | A1 | 8/2002 | Gandikota et al. |
| 2002/0127847 | A1 | 9/2002 | Alling et al. |
| 2002/0134684 | A1 | 9/2002 | Calvert et al. |
| 2002/0153260 | A1 | 10/2002 | Egli et al. |
| 2003/0010646 | A1 | 1/2003 | Barstad et al. |
| 2003/0094376 | A1 | 5/2003 | Seita et al. |
| 2003/0106802 | A1 | 6/2003 | Hagiwara et al. |
| 2003/0168343 | A1 | 9/2003 | Commander et al. |
| 2003/0205476 | A1 | 11/2003 | Calvert et al. |
| 2004/0074775 | A1 | 4/2004 | Herdman |

| | | | |
|---|---|---|---|
| 2004/0086697 | A1 | 5/2004 | Egli et al. |
| 2004/0127009 | A1 | 7/2004 | Chen et al. |
| 2004/0138075 | A1 | 7/2004 | Brown et al. |
| 2004/0154926 | A1 | 8/2004 | Sun et al. |
| 2004/0168928 | A1 | 9/2004 | Hardikar |
| 2004/0217009 | A1 | 11/2004 | Mikkola et al. |
| 2004/0222104 | A1 | 11/2004 | Wang et al. |
| 2004/0249177 | A1 | 12/2004 | Wang et al. |
| 2005/0006245 | A1 | 1/2005 | Sun et al. |
| 2005/0014368 | A1 | 1/2005 | Yoshioka et al. |
| 2005/0016858 | A1 | 1/2005 | Barstad et al. |
| 2005/0020068 | A1 | 1/2005 | Wang et al. |
| 2005/0025960 | A1 | 2/2005 | Levey et al. |
| 2005/0045485 | A1 | 3/2005 | Shih et al. |
| 2005/0045488 | A1 | 3/2005 | Paneccasio et al. |
| 2005/0061679 | A1 | 3/2005 | Hardikar |
| 2005/0067297 | A1 | 3/2005 | Tench et al. |
| 2005/0077180 | A1 | 4/2005 | Zierath et al. |
| 2005/0081744 | A1 | 4/2005 | Klocke et al. |
| 2005/0133376 | A1 | 6/2005 | Opaskar et al. |
| 2005/0176604 | A1 | 8/2005 | Lee et al. |
| 2005/0189233 | A1 | 9/2005 | Shih et al. |
| 2005/0199507 | A1 | 9/2005 | Shih et al. |
| 2005/0211564 | A1 | 9/2005 | Shih et al. |
| 2005/0230263 | A1 | 10/2005 | Dubin |
| 2005/0230354 | A1 | 10/2005 | Hardikar |
| 2005/0241946 | A1 | 11/2005 | Nagai et al. |
| 2005/0274620 | A1 | 12/2005 | Kovarsky et al. |
| 2005/0274622 | A1 | 12/2005 | Sun et al. |
| 2005/0287818 | A1 | 12/2005 | Hata et al. |
| 2006/0003566 | A1 | 1/2006 | Emesh |
| 2006/0024430 | A1 | 2/2006 | Yau et al. |
| 2006/0046079 | A1 | 3/2006 | Lee et al. |
| 2006/0081475 | A1 | 4/2006 | Barstad et al. |
| 2006/0118422 | A1 | 6/2006 | Ko et al. |
| 2006/0141156 | A1 | 6/2006 | Viel et al. |
| 2006/0141784 | A1 | 6/2006 | Paneccasio et al. |
| 2006/0183328 | A1 | 8/2006 | Barstad et al. |
| 2006/0201820 | A1 | 9/2006 | Opaskar et al. |
| 2006/0213780 | A1 | 9/2006 | Shih et al. |
| 2006/0225605 | A1 | 10/2006 | Kloeckener et al. |
| 2006/0266655 | A1 | 11/2006 | Sun et al. |
| 2007/0289875 | A1 | 12/2007 | Paneccasio et al. |
| 2008/0009132 | A1 | 1/2008 | Morikazu |
| 2008/0009136 | A1 | 1/2008 | Lee et al. |
| 2008/0087549 | A1 | 4/2008 | Ishizuka et al. |
| 2008/0090333 | A1 | 4/2008 | Haba et al. |
| 2008/0221004 | A1 | 9/2008 | Farkas |
| 2008/0230393 | A1 | 9/2008 | Okazaki et al. |
| 2009/0023820 | A1 | 1/2009 | Dailey et al. |
| 2009/0170306 | A1 | 7/2009 | Flake |

FOREIGN PATENT DOCUMENTS

| | | |
|---|---|---|
| EP | 1422320 | 5/2004 |
| EP | 1489201 | 12/2004 |
| EP | 05851560.2 | 7/2007 |
| GB | 2032462 | 5/1980 |
| JP | 01008716 | 5/1983 |
| JP | 56178125 | 5/1983 |
| JP | 58081988 | 5/1983 |
| JP | 1981178125 | 5/1983 |
| JP | 2002248397 | 9/2002 |
| JP | 20010015321 | 10/2002 |
| WO | WO 2004016829 | 2/2004 |
| WO | WO 2006053242 | 5/2006 |
| WO | WO 2008157612 | 12/2008 |

OTHER PUBLICATIONS

Gonzalez-Lopez, Jaime, et al., "Self-Associative Behavior and Drug-Solubilizing Ability of Poloxamine (Tetronic) Block Copolymers," Langmuir, vol. 24 (19), pp. 10688-10697, American Chemical Society Publications, Sep. 12, 2008.

International Preliminary Report on Patentability, PCT/US2005/040996, dated May 15, 2007.

International Preliminary Report on Patentability, PCT/US2005/040996, dated May 24, 2007.

International Search Report and Written Opinion, PCT/US2005/040996, dated May 10, 2006.

Jonsson, Bo, et al. "Surfactants and Polymers in Aqueous Solution," John Wiley & Sons Ltd, 1998.

Moffat, T.P., et al., "Superconformal Film Growth: Mechanism and Quantification," International Business Machines Corporation, vol. 49 No. 1, Jan. 2005.

Schmolka, Irving, et al., "A Review of Block Polymer Surfactants," Journal of the American Oil Chemists's Society, vol. 54, No. 3, 110-116, Mar. 1977.

Tetronic 304 Safety data sheet, Product Manual, Revision date: May 23, 2007, Version 2.0, p. 1/5.

Tetronic and Tetronic R Block Copolymer Surfactants, Product Manual, BASF Corporation, 1998-2007.

Tetronic 1107 Block Copolymer Surfactant, Product Manual, BASF Corporation, 2004.

Vereecken, P.M., et al., "The Chemistry of Additives in Damascene Copper Plating," International Business Machines Corporation, vol. 49 No. 1, Jan. 2005.

* cited by examiner

SUBSTRATE HOLDER AND ELECTROPLATING SYSTEM

BACKGROUND

Electroplating is a well-known process used in the microelectronics industry for depositing a metal film or forming other electrically conductive structures. For example, electroplating is commonly used for depositing a copper-based metallization layer from which interconnects in an integrated circuit ("IC") can be formed. Other structures that can be formed using electroplating includes through-substrate interconnects, through-mask plated films, and electroplated bumps for flip-chip type electrical connections.

In many conventional electroplating processes, a substrate to be electroplated is held in a substrate holder and immersed in an electroplating aqueous solution. A consumable or inert anode is also immersed in the electroplating aqueous solution. The substrate holder can include a base and a cover having an opening formed therein that exposes a surface of the substrate when the base and cover are assembled together. The substrate holder can also include provisions for electrically contacting the substrate, such as electrical contact pins that contact a peripheral region of the substrate. The substrate functions as a cathode of an electrochemical cell in which the electroplating aqueous solution functions as an electrolyte. A voltage source may apply a voltage between the substrate and the anode to cause metal ions from the electroplating aqueous solution to deposit onto the exposed surface of the substrate and form a plated film.

It is desirable that the electrical contact pins reliably electrically contact the substrate within the substrate holder to ensure that the plated film is deposited on the exposed surface of the substrate under controlled electrochemical conditions. For example, moving the substrate holder carrying the substrate to immerse the substrate in the electroplating aqueous solution and aggressively moving the substrate holder carrying the substrate in the electroplating aqueous solution during the electroplating process can cause the electrical contact pins to lose or unreliably contact the substrate. If the electrical contact between the electrical contact pins and the substrate is not reliable, the quality and/or uniformity of the electroplated film may not be of acceptable quality for use in an IC.

In addition to the substrate holder providing a reliable electrical contact between the substrate and the voltage source, it is often desirable to seal the electrical contact pins and regions of the substrate that are not desired to be electroplated from the electroplating aqueous solution. When the electrical contact pins are not isolated from the electroplating aqueous solution, the electrical contact pins can also be electroplated and, consequently, cause variability in the electroplated film morphology and/or thickness.

Therefore, there is still a need for an improved substrate holder that is capable of isolating selected portions of a substrate from an electroplating aqueous solution and providing a reliable electrical contact to the substrate.

SUMMARY

One or more embodiments of the invention relate to a substrate holder configured for holding at least one substrate during electroplating, an electroplating system that may employ such a substrate holder, and methods of use. In one embodiment of the invention, a substrate holder includes a base, a cover, at least one seal assembly, an electrode, and at least one compliant member. The base is configured to support a substrate that includes a surface having a peripheral region. The cover includes at least one opening configured to expose only a portion of the surface of the substrate therethrough. The at least one seal assembly is configured to substantially seal a region between the base and cover to substantially isolate the electrode from an electroplating aqueous solution environment. The electrode includes at least one contact portion that is configured to be positioned within the region substantially sealed by the at lest one seal assembly and extend over at least a portion of the peripheral region of the substrate. The at least one compliant member, comprising a polymeric material, is configured to be positioned within the region between the at least one contact portion and either the peripheral region of the substrate or the cover. During use, the electrode is electrically coupled to the peripheral region of the substrate and the exposed surface of the substrate may be electroplated.

In another embodiment of the invention, an electroplating system includes a substrate-loading station operable to load one or more substrates onto a base. The electroplating system further includes a substrate-holder-transport unit that carries a cover of a substrate holder and operable to assemble the cover with the base to form a substrate holder. The electroplating system also includes a substrate-unloading station operable to remove the one or more substrates from the base.

BRIEF DESCRIPTION OF THE DRAWINGS

The drawings illustrate several embodiments of the invention, wherein like reference numerals refer to like components or features in different views or embodiments shown in the drawings.

DETAILED DESCRIPTION

One or more embodiments of the invention relate to a substrate holder configured for holding at least one substrate during electroplating and an electroplating system that may employ such a substrate holder. The substrate holder may be employed in an electroplating system for electroplating a selected surface of the at least one substrate and may further be robust enough to be moved at a selected rate (e.g., in an oscillatory manner and/or rotated) when immersed in the electroplating aqueous solution during electroplating. For example, a compliant polymeric material may help establish and maintain electrical contact between the at least one substrate and an electrode even when the substrate holder is being moved, and/or may help reduce mechanical play between components of the substrate holder.

FIGS. 1, 2A-2B, 3, and 4 show a substrate holder 100 configured to hold at least one substrate according to one embodiment of the invention. Referring to the isometric shown in FIG. 1, the substrate holder 100 includes a base 102 and a cover 104, and substrates 106*a* and 106*b* may be secured therebetween. For example, a plurality of fasteners 107 may be used to secure the base 102 and cover 104 together to capture the substrates 106*a* and 106*b* therebetween. The base 102 and cover 104 may be formed from a material, such as ultra-high molecular weight polypropylene or another suitable material. In some embodiments of the invention, a vacuum mechanism may be used to attract the base 102 and cover 104 together by way of a vacuum port formed through the base 102 or the cover 104 instead of the fasteners 107 shown in the illustrated embodiment. As used herein, the term "substrate" refers to any workpiece capable of being electroplated. For example, suitable substrates include, but are not limited to, semiconductor substrates (e.g., single-crystal silicon wafers in full or partial form, single-crystal gallium arsenide wafer in full or partial form, etc.) with or without active and/or passive devices (e.g., transistors, diodes, capacitors, resistors, etc.) formed therein and with or without a seed layer formed thereon to promote electroplating, printed circuit boards, flexible polymeric substrates with a conductive film thereon, and many other types of substrates.

Figure 1:
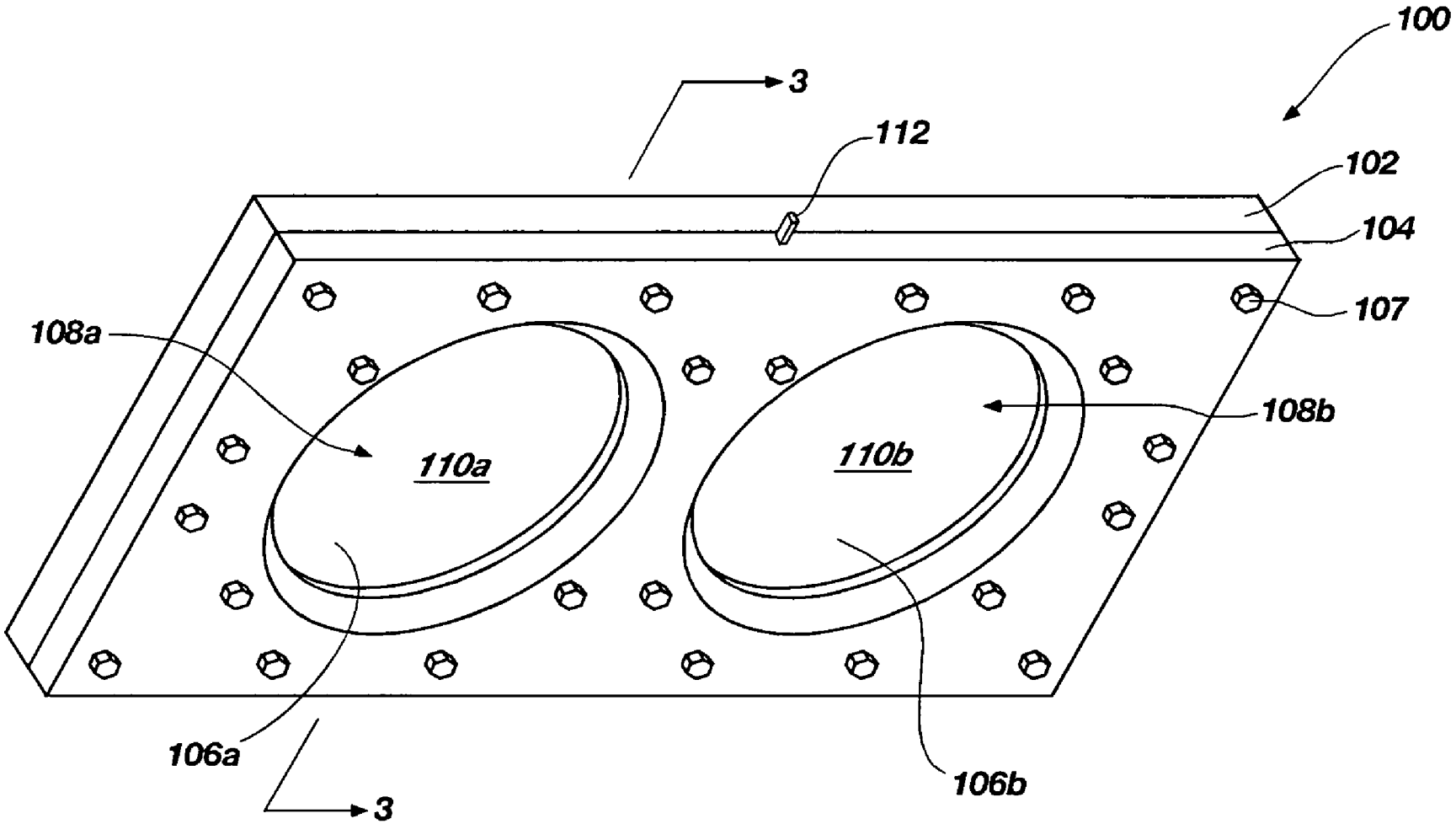
FIG. 1 is an isometric view of a substrate holder configured to hold at least one substrate according to one embodiment of the invention.

Still referring to FIG. 1, the cover 104 includes openings 108*a* and 108*b* formed therein through which surfaces 110*a* and 110*b* of corresponding substrates 106*a* and 106*b* are exposed. A bus member 112 of an electrode 206 (See FIG. 2A) projects out of the assembly of the base 102 and cover 104 to provide an externally accessible feature for electrically connecting the electrode 206 to a voltage source. For example, the electrode 206 may be made from number of different electrically conductive metals or alloys. Application of a voltage between the bus member 112 and a reference electrode when the substrate holder 100 is immersed in an electroplating aqueous solution causes the surfaces 108*a* and 108*b* to be electroplated with, for example, copper or another selected metal or alloy that is capable of being electroplated from an electroplating aqueous solution.

Figure 2A:
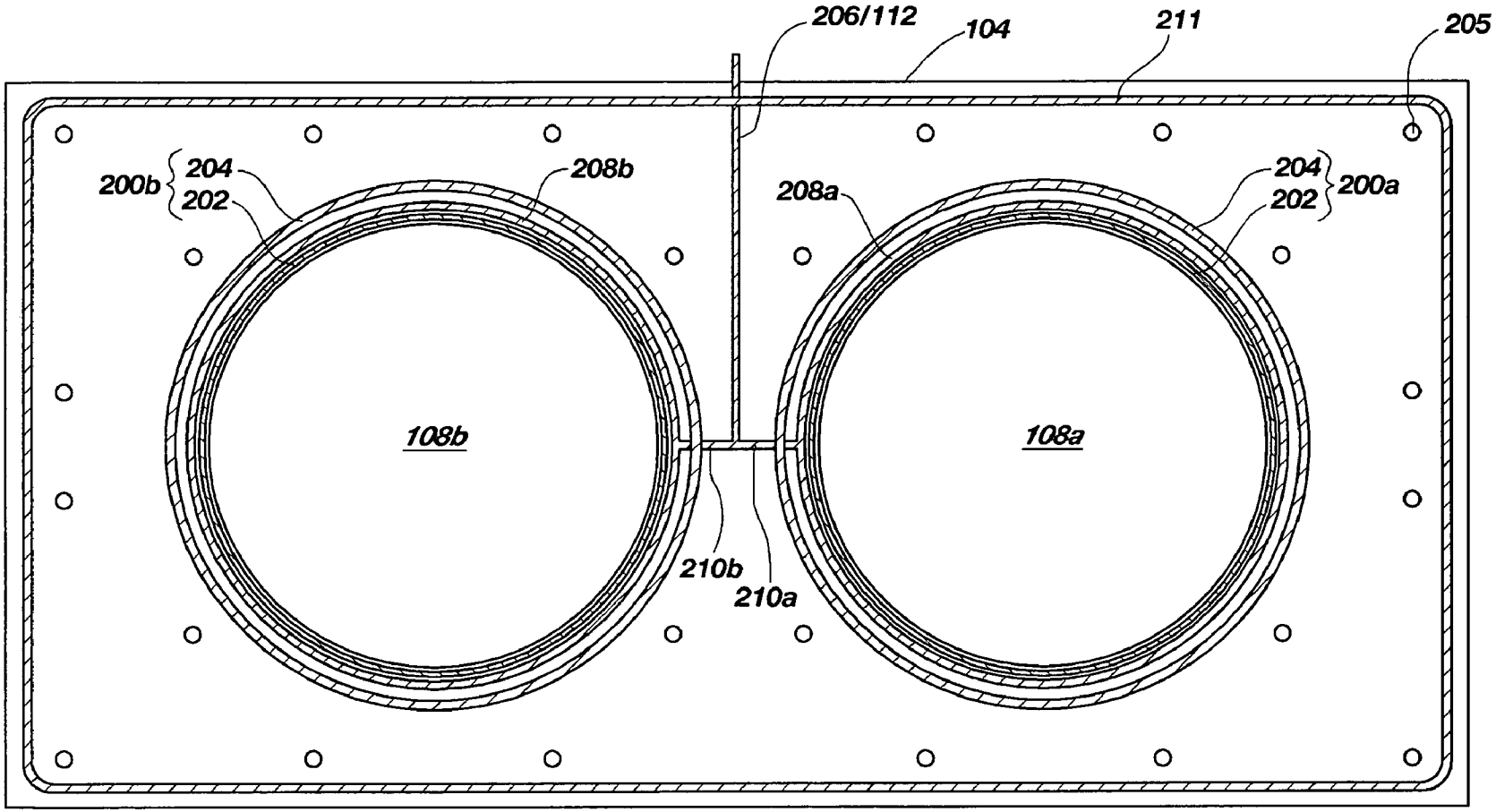
FIG. 2A is plan view of the cover shown in FIG. 1, with the seals inserted into corresponding seal seats and the electrode inserted into an electrode seat formed in the cover.

FIG. 2A is plan view of the cover 104 shown in FIG. 1 that shows many of the internal components of the substrate holder 100 in more detail. The substrate holder 100 includes seal assemblies 200*a* and 200*b*, each of which extends about a corresponding opening 108*a* and 108*b* of the cover 104. Each seal assembly 200*a* and 200*b* comprises an annular, inner seal 202 and an annular, outer seal 204 that extends circumferentially about the inner seal 202. The inner seal 202 and outer seal 204 of each seal assembly 200*a* and 200*b* may reside in corresponding seal seats 402 and 404 (See FIG. 4) formed in the cover 104. According to various embodiments of the invention, the inner seal 202 and outer seal 204 may be an O-ring, a gasket, or another suitable seal.

The electrode 206 of the substrate holder 100 is disposed within an electrode seat 406 (See FIG. 4) and under the outer seal 204. The electrode 206 includes contact rings 208*a* and 208*b* (i.e., contact portions), each of which may be generally equally spaced from the bus member 112 and electrically interconnected thereto via interconnects 210*a* and 210*b*. A more uniform current distribution over the surfaces 110*a* and 110*b* of corresponding substrates 106*a* and 106*b* may be obtained during an electroplating process by generally equally spacing the contact rings 208*a* and 208*b* from the bus member 112. The electrode 206 is configured so that the contact ring 208*a* may be positioned between the inner seal 202 and outer seal 204 of the seal assembly 200*a* and the contact ring 208*b* may be positioned between the inner seal 202 and outer seal 204 of the seal assembly 200*b*. Each interconnect 210*a* and 210*b* may include a slot (not shown) formed therein that receives a portion of a corresponding outer seal 204. When the substrate holder 100 is fully assembled, the seal assemblies 200*a* and 200*b* function to substantially seal the contact rings 208*a* and 208*b* from an electroplating aqueous solution that the substrate holder 100 is immersed in. As will be discussed in more detail with respect to FIGS. 3 and 4, the contact rings 208*a* and 208*b*, ultimately, establish electrical contact with corresponding peripheral regions of the substrates 106*a* and 106*b* when assembled between the base 102 and the cover 104. In certain embodiments of the invention, the contact rings 208*a* and 208*b* may be replaced with partial rings.

Still referring to FIG. 2A, a peripheral seal 211 (e.g., an O-ring, a gasket, or the like) may also be provided in a seal seat 408 (See FIG. 4) that extends peripherally about the seal assemblies 200*a* and 200*b* to substantially seal portions of the interconnects 210*a* and 210*b* and the bus member 112 from the electroplating aqueous solution that the substrate holder 100 is immersed in. A plurality of through holes 205 may be formed in the cover 104 in which one of the fasteners 107 (See FIG. 1) may be inserted therethrough.

Figure 2B:
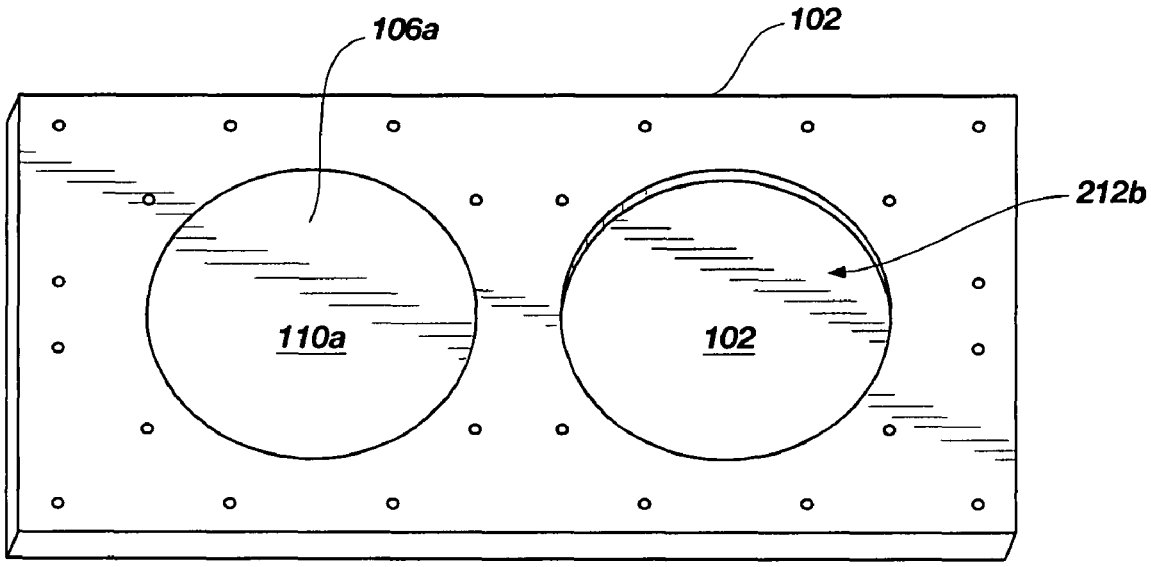
FIG. 2B is an isometric view of the base shown in FIG. 1, with a substrate positioned in one of the recess and the other recess empty.

FIG. 2B more clearly illustrates the configuration of the base 102. The base 102 includes recesses 212*a* (not shown) and 212*b* in which corresponding substrates 106*a* and 106*b* (not shown) may be received. In FIG. 2B, the recess 212*a* is not shown because the substrate 106*a* is positioned therein. The base 102 may further include a plurality of partial or through holes 214 in which one of the fasteners 107 (See FIG. 1) may be inserted therein.

Figure 3:
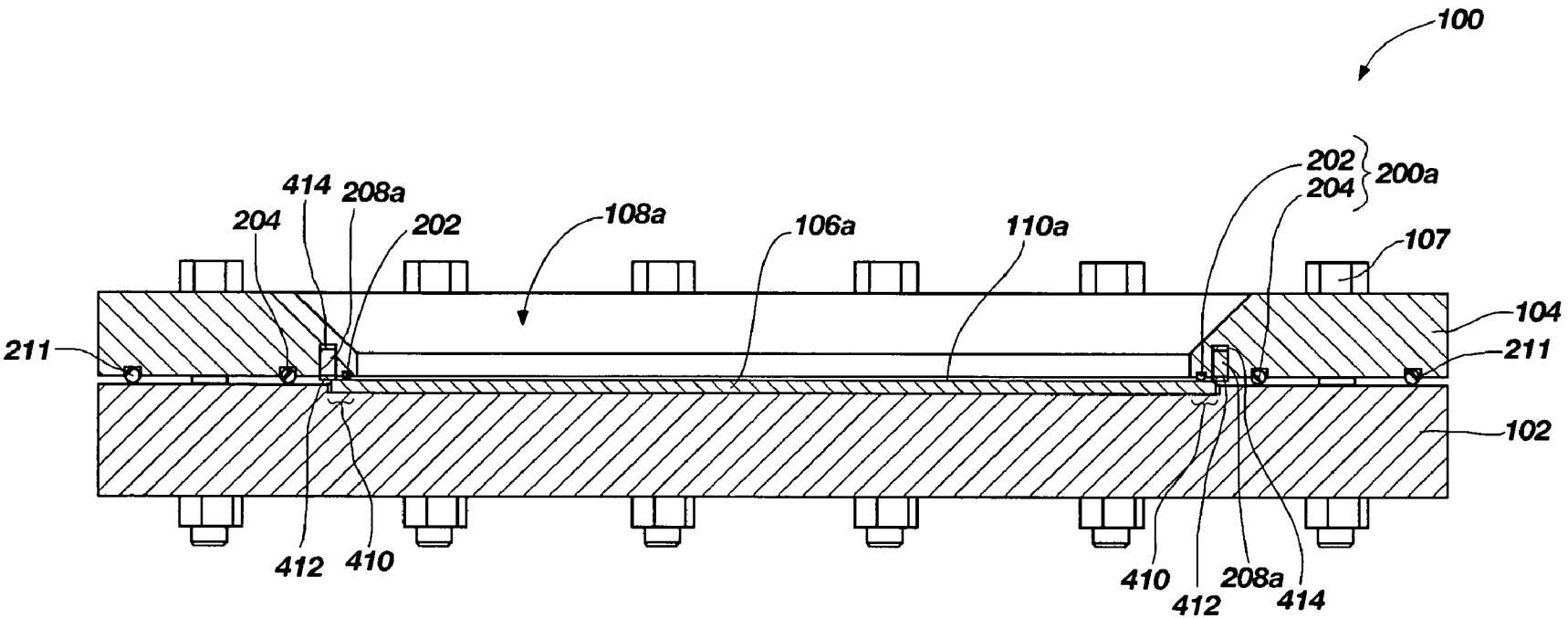
FIG. 3 is a cross-sectional view of the substrate holder shown in FIG. 1 taken along line 3-3.
Figure 4:
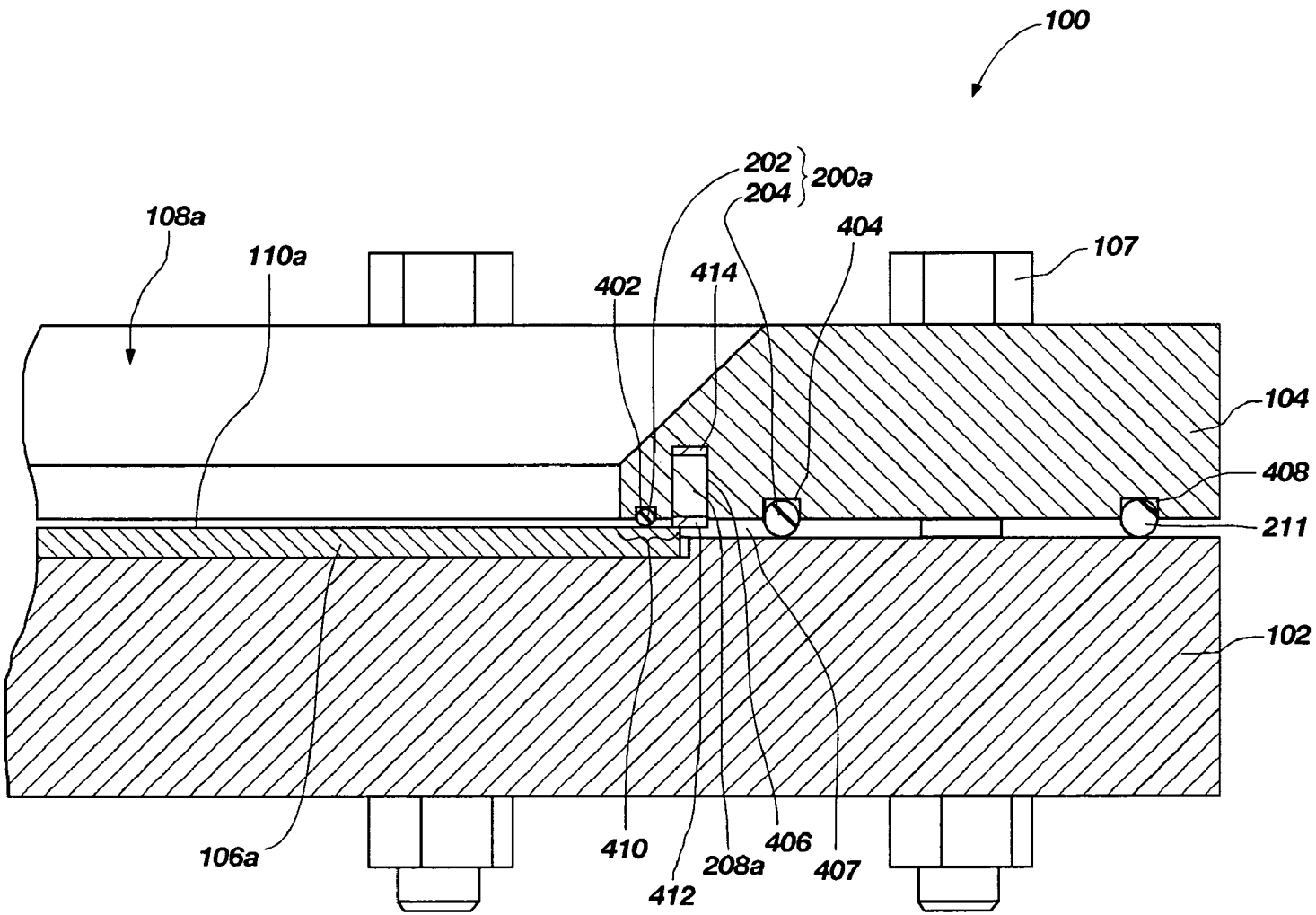
FIG. 4 is an enlarged cross-sectional view of the substrate holder shown in FIG. 3 that illustrates how an annular compliant member establishes electrical contact between an electrode and a peripheral region of the substrate.

FIGS. 3 and 4 best show how the components of the substrate holder 100 assemble together. Although the seal assembly 200*b* and contact ring 208*b* are not shown in FIGS. 3 and 4, it should be understood that they function the same as the seal assembly 200*a* and contact ring 208*a* shown in FIGS. 3 and 4. FIG. 3 is a cross-sectional view of the substrate holder 100 shown in FIG. 1 taken along line 3-3 and shows the overall assembly of the base 102, cover 104, substrate 106*a*, and relative positions of the seal assembly 200*a*, peripheral seal 211, and contact ring 208*a*.

FIG. 4 is an enlarged cross-sectional view of the substrate holder 100 shown in FIG. 3 that best shows how the contact ring 208*a* establishes electrical contact with the substrate 106*a*. The inner seal 202 and outer seal 204 of the seal assembly 200*a* each resides in corresponding seal seats 402 and 404, and the contact ring 208*a* resides in the electrode seat 406. When engaged between the base 102 and cover 104 by fastening the base 102 and cover 104 together with the fasteners 107 or by vacuum attraction, the seal assembly 200*a* comprised of the inner seal 202 and outer seal 204 forms an annular, substantially sealed region 407 adjacent to a peripheral region 410 of the surface 108*a* of the substrate 106*a*. The inner seal 202 seals with the peripheral region 410 and the cover 104, and the outer seal 204 may seal against the base 102 and the cover 104.

Still referring to FIG. 4, in the illustrated embodiment, an annular first compliant member 412, made from an electrically conductive polymer, is disposed between the contact ring 208*a* and peripheral region 410, and an annular second compliant member 414 made from a polymeric material is disposed between the contact ring 208*a* and the cover 104. Of course, it is understood, that another first compliant member 412 is disposed between the contact ring 208*b* and peripheral region 410. The first compliant member 412 may contact substantially all of the surface area of the peripheral region 410 so that an electrical potential applied to the substrate 106*a* is distributed generally uniformly over the surface 110*a* thereof.

Suitable electrically conductive polymers for the first compliant member 412 include, but are not limited to, organic electrically conductive polymers, such as polyacetylene, polypyrrole, polythiophene, polyaniline, polyfluorene, poly (3-alkylthiophene), polytetrathiafulvalene, polynaphthalene, poly(p-phenylene sulfide), and poly(para-phenylene vinylene). For example, in one specific embodiment of the invention, the first compliant member 412 may be made from polyacetylene oxidized with iodine, which exhibits an electrical conductivity similar to that of silver. In another specific embodiment of the invention, the first compliant member 412 may be made from iodine-doped polyacetylene. In another specific embodiment of the invention, the first compliant member 412 may be made from poly(3-dodecylthiophene) doped with iodine. Poly(3-dodecylthiophene) doped with iodine may exhibit an electrical conductivity of about 1000 S/cm. Other organic electrically conductive polymers that the first compliant member 412 may be made from include conductive nylon 8715, polyester urethane 4931, and polyether urethane 4901, each of which is commercially available from HiTech Polymers of Hebron, Ky. In yet another embodiment of the invention, electrically conductive particles (e.g., graphite or metallic particles) may be embedded in a polymeric matrix. In yet another embodiment of the invention, the first compliant 412 may comprise an O-ring (e.g., an O-ring made from Teflon®), polyvinyl fluoride, or polyethylene) partially or completely coated with an electrically conductive film made from a metal or alloy (e.g., gold, copper, or alloys thereof). The second compliant 414 may be made from the same or similar materials as the first compliant member 412 and does need to be electrically conductive.

Still referring to FIG. 4, the first compliant member 412 establishes electrical contact between the peripheral region 410 of the substrate 106*a* and the contact ring 208*a*. Because the first compliant member 412 is made from a compliant material (e.g., an electrically conductive polymer), it provides a reliable electrical contact to the peripheral region 410 of the substrate 106*a* even when the substrate holder 100 is being moved (e.g., during electroplating). The second compliant member 414 may help reduce any mechanical play present between the contact ring 208*a* and the cover 104 to further help maintain electrical contact between the peripheral region 410 and the first compliant member 412. Additionally, the stiffness of the first compliant member 412 may be less than that of the inner seal 202 and outer seal 204 of the seal assembly 200*b* and the peripheral seal 211 so that the sealing force applied to the substrate 106*a* is greater than that of the force applied to the contact ring 208*a*.

Figure 5:
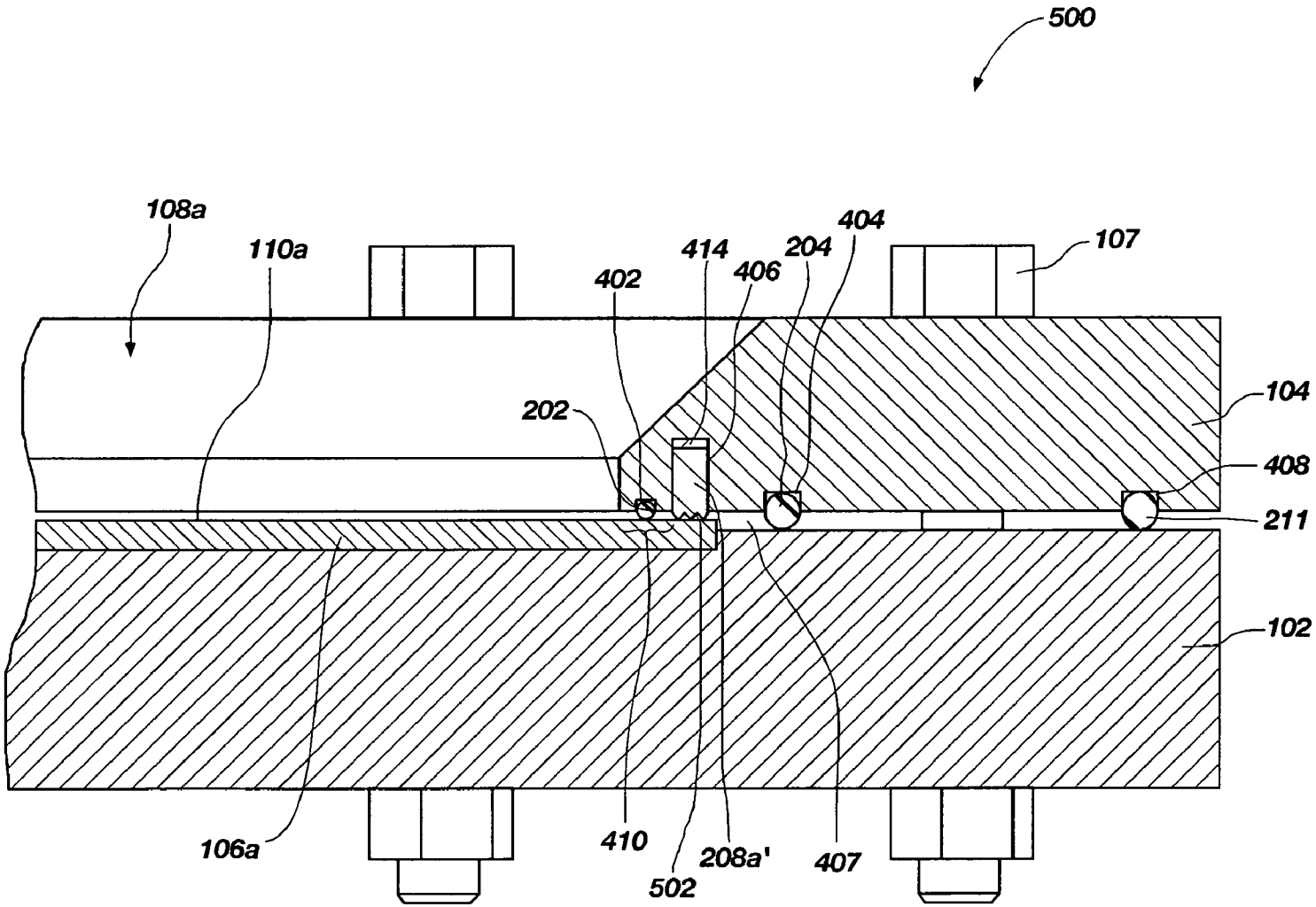
FIG. 5 is an enlarged cross-sectional view of a substrate holder including an electrode having a serrated contact surface for establishing electrical contact with a peripheral region of a substrate according to another embodiment of the invention.

FIG. 5 is an enlarged cross-sectional view of a substrate holder 500 according to another embodiment of the invention. The substrate holder 500 is structurally similar to the substrate holder 100 shown in FIGS. 1, 2A-2B, 3, and 4. Therefore, in the interest of brevity, components in both substrate holders 100 and 500 that are identical to each other have been provided with the same reference numerals, and an explanation of their structure and function will not be repeated unless the components function differently in the substrate holders 100 and 500.

Still referring to FIG. 5, the substrate holder 500 differs mainly from the substrate holder 100 shown in FIGS. 1, 2A-2B, 3, and 4 in that the substrate holder 500 has a contact ring 208*a*' with a non-planar contact surface. The contact ring 208*a*' includes a serrated contact surface 502 that establishes electrical contact with the peripheral region 410 of the surface 110*a* of the substrate 106*a*. The serrated contact surface 502 may help break through any surface oxides or debris present on the surface 110*a* of the substrate 106*a*.

Figure 6:
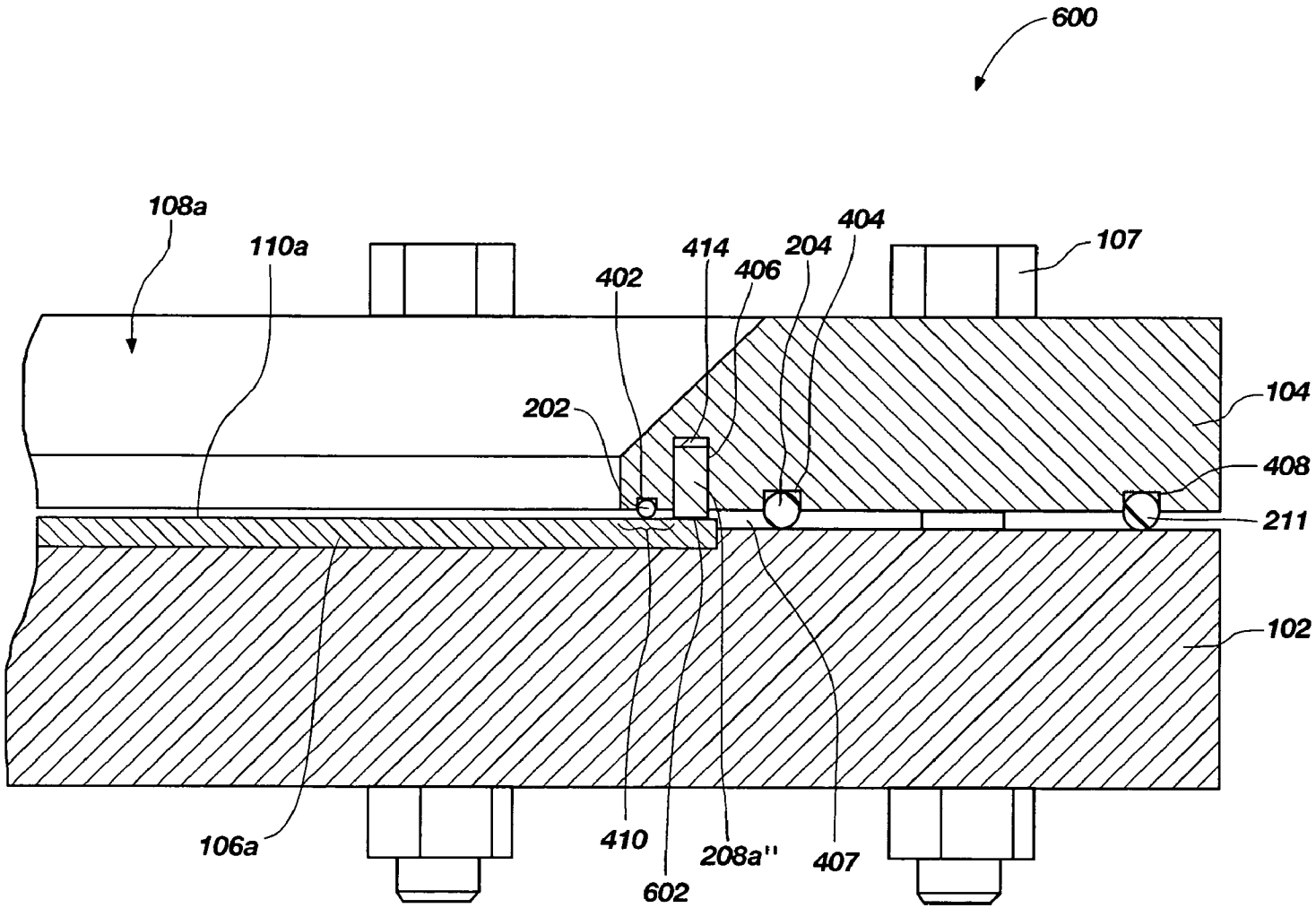
FIG. 6 is an enlarged cross-sectional view of a substrate holder including an electrode having a substantially planar contact surface for establishing electrical contact with a peripheral region of a substrate according to yet another embodiment of the invention.

FIG. 6 is an enlarged cross-sectional view of a substrate holder 600 according to another embodiment of the invention. The substrate holder 600 is structurally similar to the substrate holder 100 shown in FIGS. 1, 2A-2B, 3, and 4. Therefore, in the interest of brevity, components in both substrate holders 100 and 600 that are identical to each other have been provided with the same reference numerals, and an explanation of their structure and function will not be repeated unless the components function differently in the substrate holders 100 and 600. The substrate holder 600 differs mainly from the substrate holder 100 shown in FIGS. 1, 2A-2B, 3, and 4 in that the substrate holder 600 includes a contact ring 208*a*" with a substantially planar contact surface 602 that establishes electrical contact with the peripheral region 410 of the surface 110*a* of the substrate 110*a*.

It is noted that in the substrate holders 100, 500, and 600 shown in FIGS. 3, 5, and 6, the second compliant member 414 may be omitted. However, the thickness of the contact rings 208*a*/208*b*, 208*a*', and 208*a*" should be suitably increased to help prevent any mechanical play with the cover 104.

Figure 7:
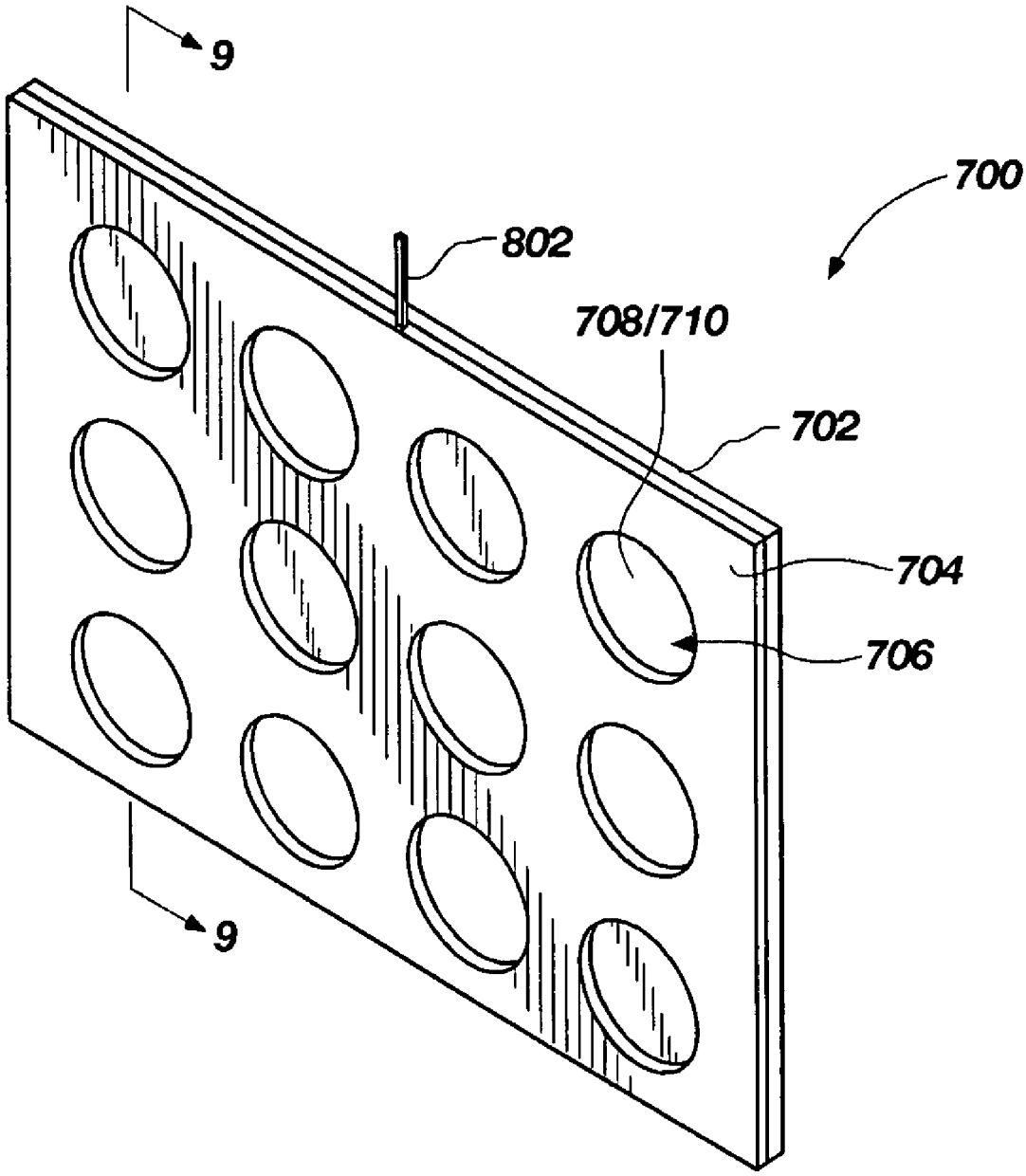
FIG. 7 is an isometric view of a substrate holder configured to hold two or more substrates according to another embodiment of the invention.

FIG. 7 is an isometric view of a substrate holder 700 configured to hold two or more substrates according to another embodiment of the invention. The substrate holder 700 enables electroplating a greater number of substrates at one time than the substrate holders 100, 500, and 600 shown in FIGS. 1, 5, and 6. Accordingly, the substrate holder 700 provides a greater process throughput in electroplating processes than the substrate holders 100, 500, and 600.

Still referring to FIG. 7, the substrate holder 700 includes a base 702 and a cover 704. The cover 704 includes a plurality of openings 706 formed therein that expose corresponding surfaces 708 of substrates 710 therethrough captured between the cover 704 and the base 102. A main bus member 802 of an electrode 800 (See FIG. 8) projects out of the assembly of the base 102 and cover 104 to provide an externally accessible feature for electrically connecting the electrode 800 to a voltage source during electroplating operations.

Figure 8:
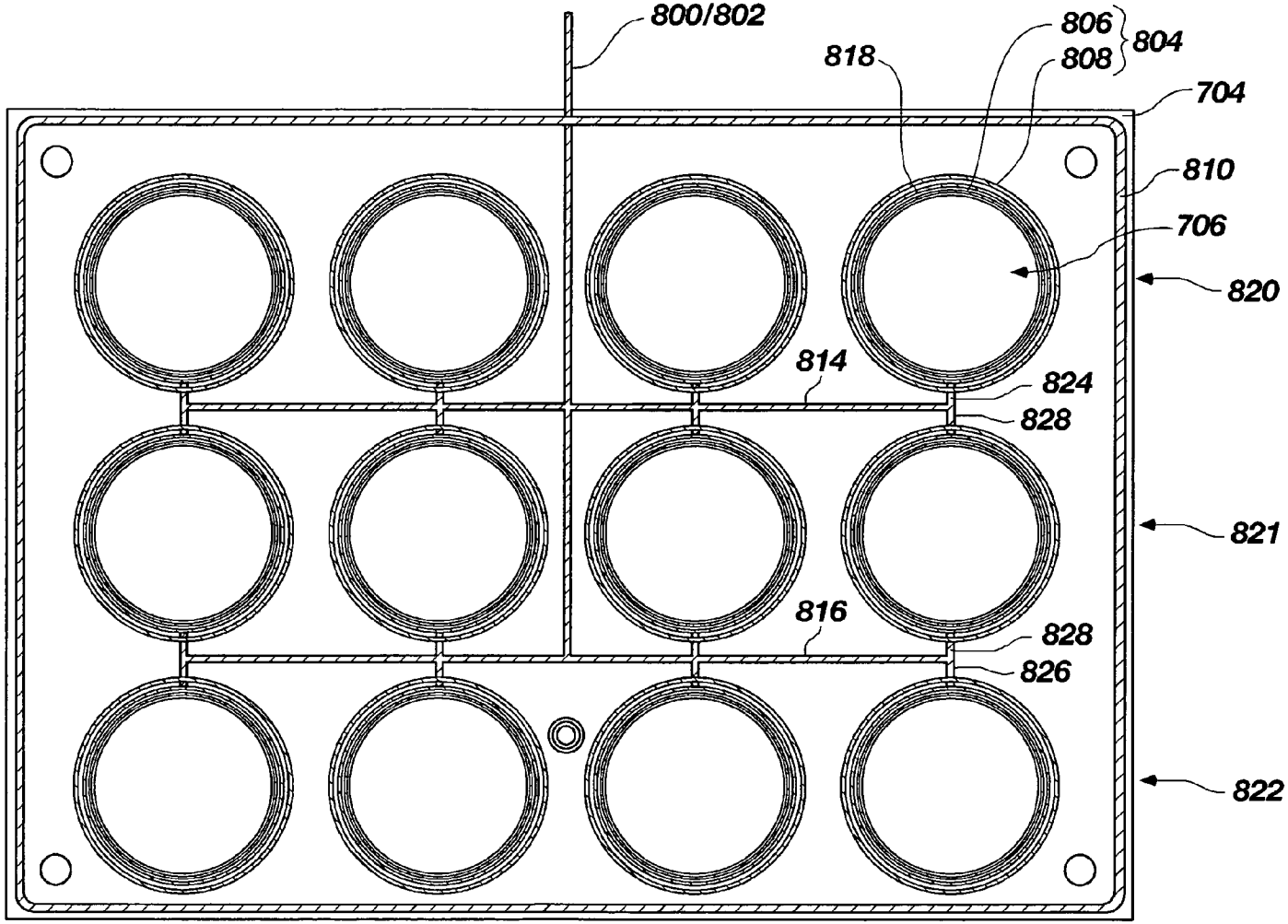
FIG. 8 is plan view of the cover shown in FIG. 7, with the seals inserted into corresponding seal seats and the electrode inserted into an electrode seat formed in the cover.

FIG. 8 is plan view of the cover 704 shown in FIG. 7 that shows many of the internal components of the substrate holder 700 in more detail. It is noted that the substrate holder 700 differs mainly from the substrate holder 100 in that the structure of the electrode 800 is different. As shown in FIG. 8, the substrate holder 700 includes a plurality of seal assemblies 804, each of which includes an inner seal 806 (e.g., an O-ring, a gasket, or the like) and an outer seal 808 (e.g., an O-ring, a gasket, or the like) extending thereabout. Each inner seal 806 and outer seal 808 is disposed in a corresponding seal seat 906 and 908 (See FIG. 9) and extends about a corresponding opening 706. A peripheral seal 810 (e.g., an O-ring, a gasket, or the like) similar in structure and functionality to the peripheral seal 211 shown in FIG. 2A of the substrate holder 100 may be disposed in a seal seat 910 (See FIG. 9) formed in the cover 704.

Still referring to FIG. 8, the electrode 800 is disposed within an electrode seat 909 (See FIG. 9) formed in the cover 704 and under the outer seals 808. The electrode 800 includes bus bars 814 and 816 connected to the main bus member 802. The electrode 800 further includes a plurality of contact rings 818 arranged in rows 820-822. Each contact ring 818 of the row 820 is connected to the bus bar 814 via an interconnect 824, each contact ring 818 of the row 822 is connected to the bus bar 816 via an interconnect 826, and each contact ring 818 of the row 821 is connected to both the bus bar 814 and 816 via interconnects 828. Each contact ring 818 may be spaced from the bus bar 814, 816, or both a substantially equal distance.

Figure 9:
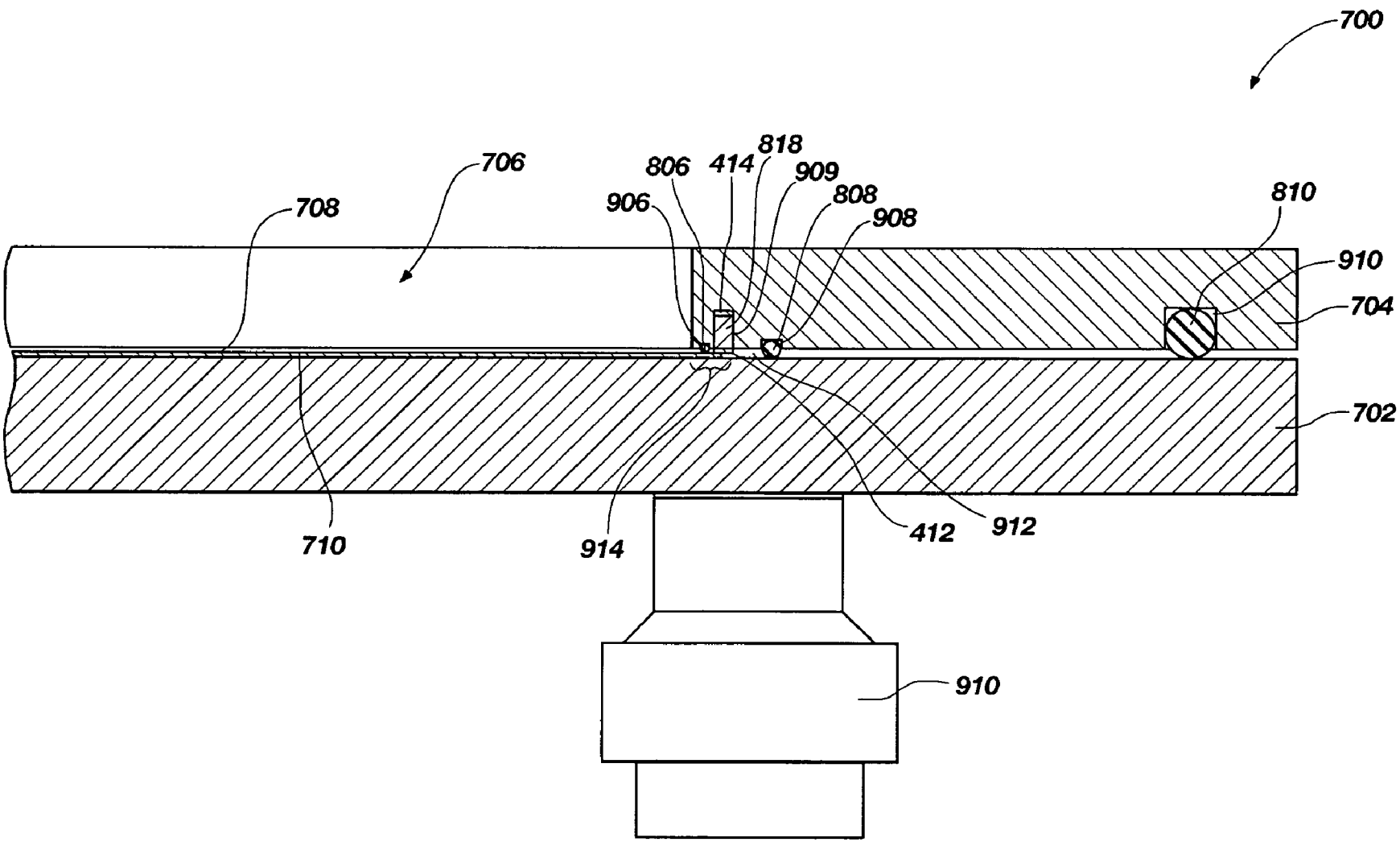
FIG. 9 is an enlarged, partial cross-sectional view of the substrate holder shown in FIG. 7 taken along line 9-9.

FIG. 9 is an enlarged, partial cross-sectional view of the substrate holder 700 shown in FIG. 7 taken along line 9-9. As with the electrode 206 of the substrate holder 100 shown in FIGS. 1, 2A-2B, 3, and 4, each contact ring 818 is disposed between the inner seal 806 and outer seal 808 of a corresponding seal assembly 804. When the base 702 and cover 704 are urged together, the seal assemblies 804 substantially seal the contact rings 818 from an electroplating aqueous solution that the substrate holder 800 is immersed in. For example, vacuum plug 910 communicates with the space between the inner seal 806 and outer seal 808 through a vacuum port (not shown) formed in the base 702 so that a vacuum source may be used to attract the base 702 and cover 704 together and engage the seal assemblies 804 and the peripheral seal 810. However, in other embodiments of the invention, the vacuum port may be formed in the base 702 instead of the cover 704. In another embodiment of the invention, a plurality of fasteners may be used to urge the base 702 and cover 704 together to engage the seal assemblies 804 and the peripheral seal 810 in a manner similar to the substrate holder 100 shown in FIG. 1.

Still referring to FIG. 9, in a manner similar to the substrate holder 100, each seal assembly 804 forms an annular substantially sealed region 912 adjacent to a peripheral region 914 of the surface 708 of the substrate 710. Each contact ring 818 may be disposed within a corresponding sealed region 912. Additionally, an annular first compliant member 412 may be disposed between a corresponding contact ring 818 and the peripheral region 914 to established electrical contact with a corresponding substrate 710 and an annular second compliant member 414 may be disposed between the corresponding contact ring 818 and the cover 704.

In other embodiments of the invention, each contact ring 818 of the electrode 800 may have a non-planar contact surface, such as a serrated contact surface similar to the contact ring 208*a*' shown in FIG. 5 and the first compliant members 414 may be omitted. In yet another embodiment each contact ring 818 may have a substantially planar contact surface similar to the contact ring 208" shown in FIG. 6 and the first compliant members 414 may be omitted. In further embodiments of the invention, the second compliant members 416 used to reduce mechanical play between the electrode 800 and the cover 704 may be omitted.

Figure 10:
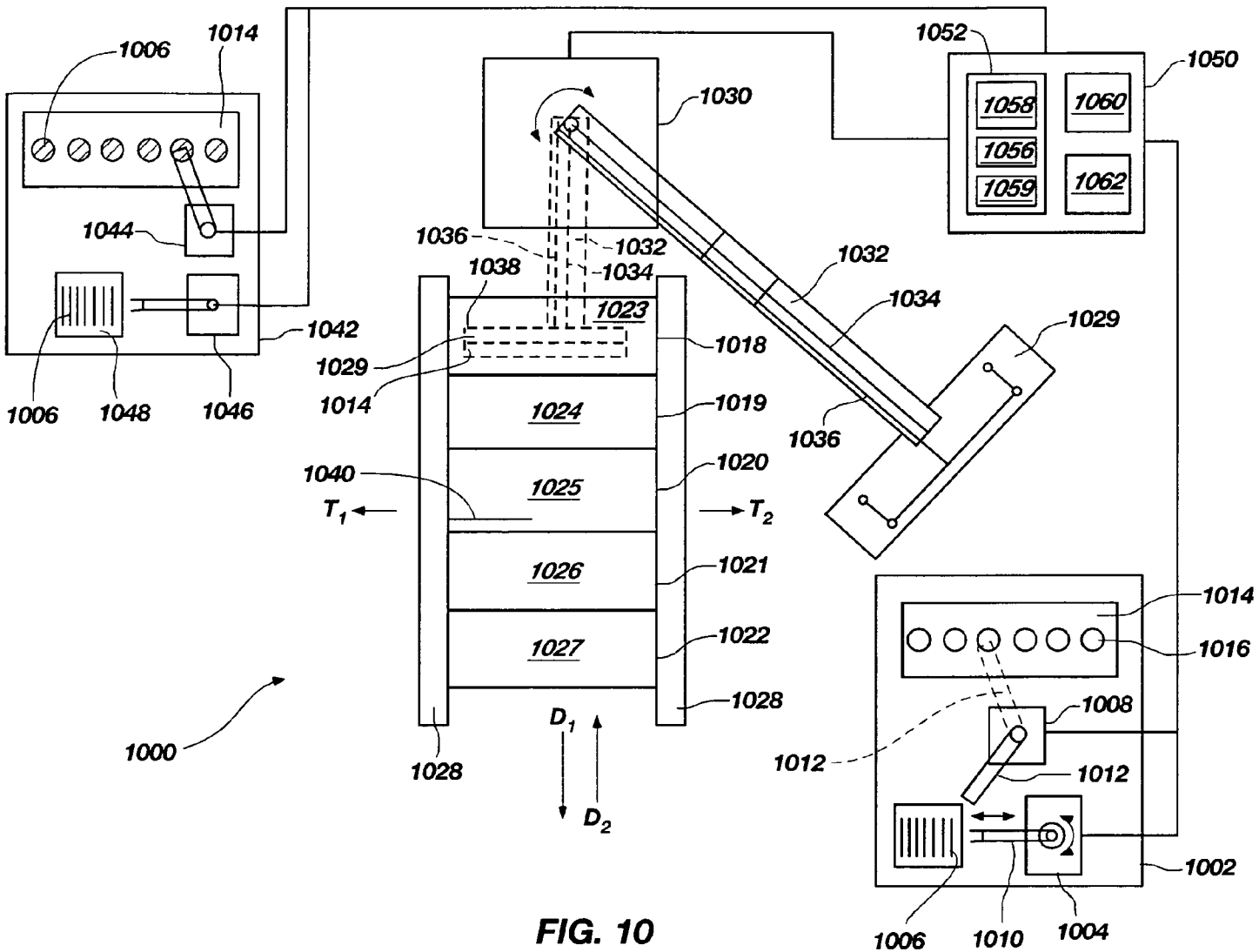
FIG. 10 is schematic diagram of an electroplating system that may utilize any of the disclosed substrate holder embodiments according to another embodiment of the invention.

FIG. 10 is a schematic diagram of an electroplating system 1000 that may employ any of the above-described embodiments of substrate holders according to another embodiment of the invention. The electroplating system 1000 includes a substrate-loading station 1002 that may include a substrate-presentation unit 1004 operable to pick-up a substrate 1006 (a cartridge of substrates 1006 is depicted in FIG. 10) and present the substrate 1006 to a substrate-loading unit 1008. For example, the substrate-presentation unit 1004 may be a robot with an extensible arm 1010 movable about three axes and having a retention mechanism, such as a vacuum mechanism or forks (as illustrated) that may support the substrate 1006. The substrate-loading unit 1008 may include an extensible arm 1012 that is also movable about three axes and may have a similarly configured retention mechanism operable to pick-up and carry one of the substrates 1006. The arm 1012 has a range of motion so that it can transport the substrates 1006 to controllably place them onto a base 1014 (depicted configured similar to the base 702 of the substrate holder 700). During use, the substrate-loading unit 1008 may place one of the substrates 1006 in each recess 1016 of the base 1014.

The electroplating system 1000 further includes a plurality of isolated containers, each of which holds a specific fluid. In the illustrated embodiment, containers 1018-1022 are shown. For example, the container 1018 may hold a cleaning solution 1023, container 1019 may hold a rinsing solution 1024 (e.g., water), container 1020 may hold an electroplating aqueous solution 1025 (e.g., as a sulfuric-acid-based solution), container 1021 may hold a post-plating cleaning solution 1026, and container 1022 may hold a solution (e.g., isopropyl alcohol) to promote drying of a plated substrate after cleaning in the post-plating cleaning solution 1026. In some embodiments of the invention, the containers 1018-1022 may be supported on a conveyor 1028 operable to move the containers 1018-1022 in conveying directions $D_1$ and $D_2$.

The electroplating system 1000 further includes a substrate-holder transport unit 1030 having an extensible arm 1032 that is movable about three axes. The arm 1032 may carry a cover 1029 (depicted configured similar to the cover 704 of the substrate holder 700) including an electrode (not shown), compliant members (not shown), and various seals (not shown). For example, the cover 1029 may carry the internal components previously discussed (e.g., the seal assembly, peripheral seal, electrode, compliant members, etc.) with respect to the substrate holders 100, 500, and 600. The substrate-holder transport unit 1030 may further include provisions for electrically connecting the electrode (not shown) embedded in the cover 1029 to a voltage source 1060, such as a wire 1034 that extends along the length of the arm 1032, and a vacuum line 1036 for communicating a vacuum force through one or vacuum ports formed in the cover 1029.

During use, the substrate-holder-transport unit 1030 may controllably position the cover 1029 on the base 1014 loaded with substrates 1006 at the substrate-loading station 1002 and communicate a vacuum force through the vacuum line 1036 to urge the base 1014 and cover 1029 together to form an assembled substrate holder 1038 (depicted configured similar to the substrate holder 700).

Figure 11:
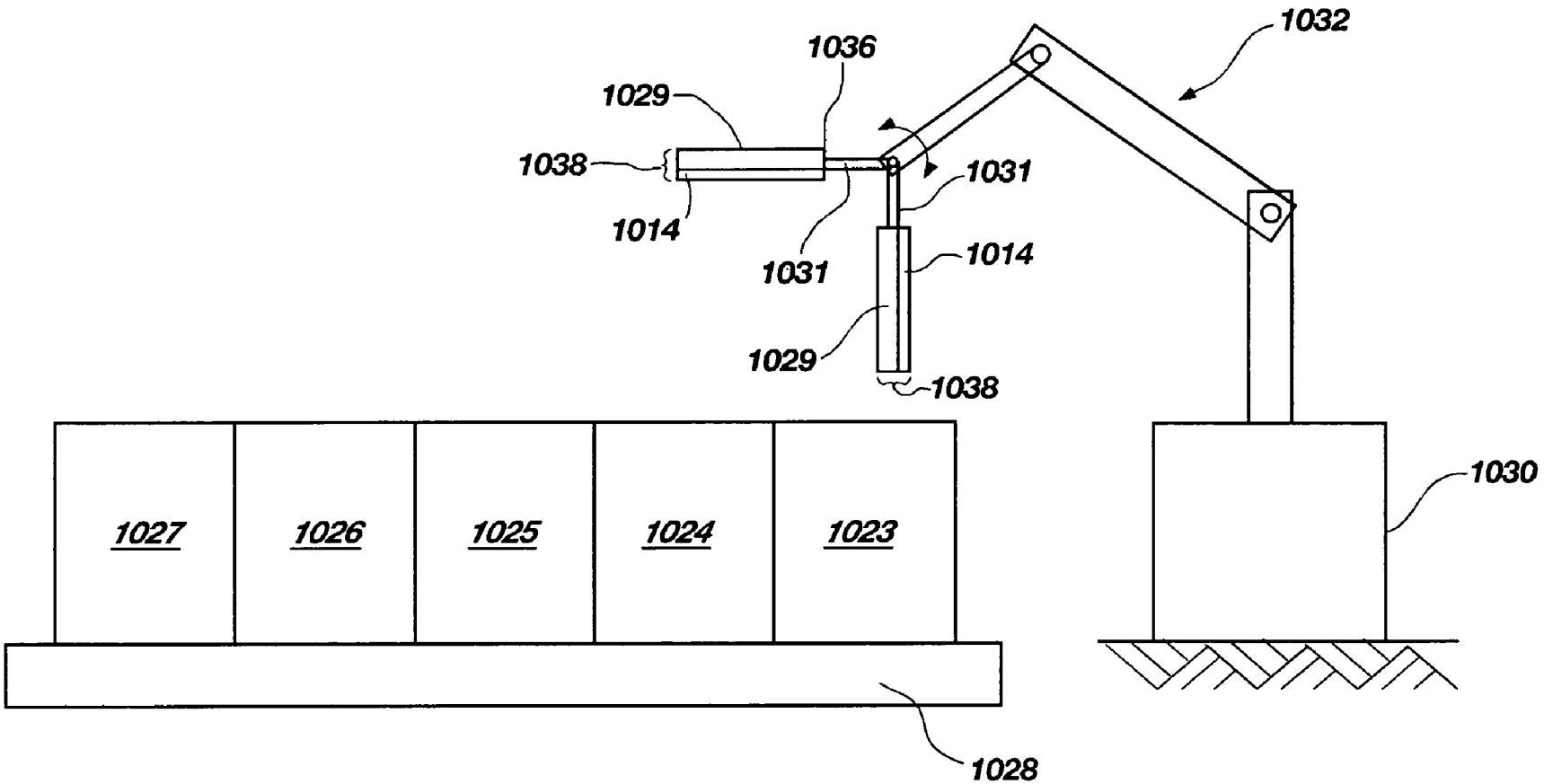
FIG. 11 is a schematic diagram illustrating how the substrate-holder-transport unit is operable to rotate a substrate holder prior to immersion into a container.

As shown in FIG. 11, if desired, the substrate-holder-transport unit 1030 may rotate the substrate holder 1038 from a generally horizontal orientation to a generally vertical orientation so that the substrate holder 1038 may be more easily immersed in each container 1018-1022. For example, the cover 1029 of the substrate holder 1038 may be pivotally connected to the arm 1032 via hinge 1031. Then, the substrate holder 1038 may be sequentially immersed in each container 1018-1022. In certain embodiments of the invention, the substrate holder 1038 is moved in the directions $D_1$ and/or $D_2$ by extending or retracting the arm 1032, as desired. In other embodiments of the invention, the containers 1018-1022 may be translated in the direction $D_1$ and/or $D_2$ using the conveyor 1028, as necessary or desired. When the substrate holder 1038 is immersed in the electroplating aqueous solution 1025 of the container 1020, a selected voltage or voltage waveform may be applied between the electrode (not shown) embedded in the substrate holder 1038 and an anode 1040 immersed in the electroplating aqueous solution 1025 to cause metals ions from the electroplating aqueous solution to deposit on an exposed surface of the substrates 1006. Additionally, the substrate-holder-transport unit 1030 may move the substrate holder 1038 (e.g., in a linearly oscillatory manner parallel to the anode 1040 in directions $T_1$ and $T_2$) to help improve electroplating characteristics.

In another embodiment of the invention, the substrate-holder-transport unit 1030 may be an overhead conveyor system that the cover 1029 is mounted on.

The electroplating system 1000 may also include a substrate-unloading station 1042 having a substrate-unloading unit 1044 that is configured the same or similarly to the substrate-loading unit 1008. The substrate-unloading station 1042 may also include a substrate-stacking unit 1046 that is configured the same or similarly to the substrate-loading unit 1008 for carrying substrates 1006 presented to it by the substrate-unloading unit 1044 and stacking the substrates 1006 in a cartridge 1048.

After electroplating the substrates 1006 and rinsing the electroplating substrates 1006, the substrate-transport unit 1030 may move the substrate holder 1038 including electroplated substrates 1006 carried therein to the substrate-unloading station 1042 and de-activate the vacuum mechanism holding the base 1014 and cover 1029 together to thereby release and leave the base 1014 at the substrate-unloading station 1042. Then, the substrate-unloading unit 1044 may individually pick-up and present each substrate 1006 to the substrate-stacking unit 1046 for stacking in the cartridge 1048.

The electroplating system 1000 also comprises a control system 1050 that may include a computer 1052 with a processor 1054, a memory 1056, an operator interface 1058 (e.g., a monitor, keyboard, mouse, etc.), and may further include many other familiar computer components. The control system 1050 may further include a voltage source 1060 operable to apply a selected voltage between the electrode (not shown) embedded in the substrate holder 1038 and the anode 1040 to effect electroplating of the substrates 1006, and a pump 1062 operable to generate a vacuum force communicated through the vacuum line 1036 that urges the base 1014 and cover 1029 together. The control system 1050 may be programmed, with computer readable instructions stored on the memory 1056, to control the operation of the individual components of the electroplating system 1000 (e.g., the substrate-presentation unit 1004, substrate-loading unit 1008, substrate-holder-conveyor unit 1030, substrate-unloading unit 1044, and substrate-stacking unit 1046), as described above.

From the foregoing it will be appreciated that, although specific embodiments of the invention have been described herein for purposes of illustration, various modifications may be made without deviating from the spirit and scope of the invention. For example, the recesses formed in the base of the substrate holders described above that receive substrates may be omitted. Additionally, although the seal and electrode seats are shown and described in the illustrated embodiments as being formed in the cover of the substrate holders, the seal and electrode seats may, instead, be formed in the base.

The invention claimed is:

1. A substrate holder, comprising:

a base configured to support a first substrate including a first surface having a first peripheral region;

a cover including a first opening configured to expose only a portion of the first surface therethrough;

a first seal assembly configured to substantially seal a first region between the base and the cover;

an electrode including a first contact portion that is configured to be positioned within the first region and extend over at least a portion of the first peripheral region; and a first compliant member comprising a polymeric material, the first compliant member configured to be positioned within the first region between the first contact portion and either the first peripheral region of the first substrate or the cover, wherein the polymeric material comprises an electrically conductive polymer.

2. The substrate holder of claim 1 wherein the polymeric material comprises one of the following:

an organic electrically conductive polymer; and a polymeric matrix including electrically conductive particles embedded therein.

3. The substrate holder of claim 1 wherein the first contact portion of the electrode exhibits an annular configuration and includes a contact surface having a selected non-planar geometry.

4. The substrate holder of claim 1 wherein the first compliant member is configured to be positioned between the first contact portion and the first peripheral region to establish electrical contact therebetween; and further comprising a second compliant member configured to be positioned between the cover and the first contact portion to reduce mechanical play therebetween.

5. The substrate holder of claim 1 wherein:

the first seal assembly comprises a first inner seal and a first outer seal; and the cover comprises:

a first inner seal seat formed in the cover configured to receive the inner seal;

a first outer seal seat formed in the cover configured to receive the outer seal; and a first electrode seat formed in the cover configured to receive the electrode.

6. The substrate holder of claim 5 wherein each of the first inner seal and the first outer seal comprises one of the following types of seals: an O-ring; and a gasket.

7. The substrate holder of claim 1, further comprising:

an attraction mechanism operable to urge the cover and the base together to retain the first substrate therebetween.

8. The substrate holder of claim 1, further comprising:

a seal configured to extend about the first seal assembly and the first substrate.

9. An electroplating system, comprising:

a substrate-loading station operable to load one or more substrates onto a base;

a substrate-holder-transport unit operable to assemble the cover with the base to form the substrate holder of claim 1; and a substrate-unloading station operable to remove the one or more substrates from the base.

10. The electroplating system of claim 9, further comprising:

at least one container holding an electroplating aqueous solution; and a conveyor supporting the at least one container.

11. The electroplating system of claim 9 wherein the substrate-loading station comprises:

a substrate-presentation unit operable to pick-up the one or more substrates loaded in a cartridge; and a substrate-loading unit operable to carry each of the one or more substrates presented thereto by the substrate-presentation unit and controllably place each of the one or more substrates onto the base.

12. The electroplating system of claim 9 wherein the substrate-holder-transport unit comprises a vacuum line through which a vacuum force can be applied to urge the cover and the base together.

13. The electroplating system of claim 9 wherein the substrate-holder-transport unit comprises an electrical wire electrically coupled to an electrode embedded within the cover.

14. The electroplating system of claim 9 wherein the substrate-holder-transport unit comprises a movable arm pivotally coupled to the cover.

15. The electroplating system of claim 9 wherein the substrate-unloading station comprises:

a substrate-unloading unit operable to carry each of the one or more substrates positioned on the base; and a substrate-stacking unit operable to individually stack each of the one or more substrates presented by the substrate-unloading unit.

16. A substrate holder, comprising:

a base configured to support a substrate including a surface having a peripheral region;

a cover assembled with the base, the cover including at least one opening exposing only a portion of the surface therethrough;

a seal assembly substantially sealing a region between the cover and base and further adjacent to the peripheral region of the substrate;

an electrode including at least one contact portion positioned within the region and extending over at least a portion of the peripheral region of the substrate; and a compliant member comprising a polymeric material, the compliant member positioned within the region between the at least one contact portion and either the peripheral region of the substrate or the cover, wherein the polymeric material comprises an electrically conductive polymer.

17. A substrate holder, comprising:

a base configured to support a first substrate including a first surface having a first peripheral region;

a cover including a first opening configured to expose only a portion of the first surface therethrough;

a first seal assembly configured to substantially seal a first region between the base and the cover;

an electrode including a first contact portion that is configured to be positioned within the first region and extend over at least a portion of the first peripheral region; and a first compliant member comprising a polymeric material, the first compliant member configured to be positioned within the first region between the first contact portion and either the first peripheral region of the first substrate or the cover, wherein the first compliant member comprises an O-ring formed from the polymeric material and coated with an electrically conductive material.

18. A substrate holder, comprising:

a base configured to support a first substrate including a first surface having a first peripheral region;

a cover including a first opening configured to expose only a portion of the first surface therethrough;

a first seal assembly configured to substantially seal a first region between the base and the cover;

an electrode including a first contact portion that is configured to be positioned within the first region and extend over at least a portion of the first peripheral region;

a first compliant member comprising a polymeric material, the first compliant member configured to be positioned within the first region between the first contact portion and either the first peripheral region of the first substrate or the cover, wherein the base is further configured to support a second substrate including a second surface having a second peripheral region, wherein the cover comprises a second opening configured to expose a portion of the second surface therethrough, and wherein the electrode comprises:

a second contact portion spaced from the first contact portion; and a bus member electrically interconnecting the first contact portion and the second contact portion;

a second seal assembly configured to substantially seal a second region between the base and the cover; and a second compliant member comprising a polymeric material, the second compliant member configured to be positioned within the second region between the second contact portion and either the second peripheral region of the second substrate or the cover.

19. The substrate holder of claim 18 wherein the first contact portion and the second contact portion are spaced substantially the same distance from the bus member.

20. A substrate holder, comprising:

a base configured to support a first substrate including a first surface having a first peripheral region;

a cover including a first opening configured to expose only a portion of the first surface therethrough;

a first seal assembly configured to substantially seal a first region between the base and the cover;

an electrode including a first contact portion that is configured to be positioned within the first region and extend over at least a portion of the first peripheral region; and a first compliant member comprising a polymeric material, the first compliant member configured to be positioned within the first region between the first contact portion and either the first peripheral region of the first substrate or the cover, wherein the first seal assembly comprises a first inner seal and a first outer seal each of which is made from a resilient material exhibiting a higher stiffness than that of the polymeric material.

* * * * *